United States Patent [19]

Chan

[11] Patent Number: 5,065,871

[45] Date of Patent: Nov. 19, 1991

[54] MULTI-DECK TYPE OF ROTARY SHOE RACK

[76] Inventor: Huan-Yin Chan, No. 96, Yung Shoe Road, Hsiang, Changhua Hsin Chuang Village, Yung Ching, Taiwan

[21] Appl. No.: 675,338

[22] Filed: Mar. 26, 1991

[51] Int. Cl.[5] ..... A47F 7/08

[52] U.S. Cl. ..... 211/37; 12/128 B; 211/163

[58] Field of Search ..... 211/37, 34, 163, 196, 211/205; 12/128 B

[56] References Cited

U.S. PATENT DOCUMENTS

| | | | |
|---|---|---|---|
| 1,691,293 | 11/1928 | Larson | 211/163 |
| 2,941,669 | 6/1960 | Palpal et al. | 211/163 X |
| 3,979,786 | 9/1976 | Vierra et al. | 12/128 B |
| 4,614,272 | 9/1986 | Shelton et al. | 211/163 |
| 4,667,817 | 5/1987 | Im et al. | 12/128 B X |
| 4,889,246 | 12/1989 | Lee | 211/163 |

*Primary Examiner*—Blair M. Johnson
*Assistant Examiner*—Korie H. Chan
*Attorney, Agent, or Firm*—Bacon & Thomas

[57] ABSTRACT

A rotary shoe rack, comprising a post for mounting a plurality of ring-shaped rotary members respectively vertically separated from one another by a plurality of sockets permitting said ring-shaped rotary members to be respectively rotated with respect to said sockets. The ring-shaped rotary members have each a plurality of supporting rods obliquely extending upward outward therefrom around a circle for mounting a shoe each, which supporting rods have each a chemical bag at the top with aromatics contained therein to expel odor smell from the shoe mounted thereon.

1 Claim, 2 Drawing Sheets

MULTI-DECK TYPE OF ROTARY SHOE RACK

BACKGROUND OF THE INVENTION

1. Field of the Invention

The present invention relates to shoe racks, and more particularly relates to a multi-deck type of rotary shoe rack which have a plurality of supporting rods at each rotary deck thereof for holding a shoe each, which supporting rods have each a chemical bag at the top for expelling odor smell from the shoe mounted thereon.

2. Description of Prior Art

At the entrance of a house, room or building, shoe rack may be provided for keeping shoes. The known structure of shoe rack is generally comprised of a cabinet having one or more plates transversely set therein for holding shoes. Because the cabinet is generally closed by a door, odor smell from the shoes put therein can not be dissipated. There are some models in which the door of the cabinet is made with a plurality of vent holes for circulation of air. However, because a shoe rack is generally placed inside a building, no sufficient current of air could be formed to carry odor smell out of the cabinet and the shoes therein. Recently, there has been disclosed a shoe rack designed in structure similar to regular clothes rack, having a plurality of pegs obliquely extending upward from a trunk for holding shoes. Because the trunk is not rotatable, it is inconvenient to mount shoes on the pegs or pick up shoes therefrom.

SUMMARY OF THE INVENTION

The present invention has been accomplished under the circumstances in view. It is the main object of the present invention to provide a multi-deck type of rotary shoe rack which has means to expel odor smell from the shoe mounted thereon. It is still another object of the present invention to provide a multi-deck type of rotary shoe rack which is practical in use so that a big number of shoes can be conveniently mounted thereon in good order or picked up therefrom easily.

According to the present invention, there is provided a multi-deck type of rotary shoe rack which comprises a plurality of rotary members revolvably mounted on a post and respectively separated from one another by a plurality of sockets, which rotary members have each a plurality of supporting rods obliquely extending upward outward therefrom around a circle for mounting a shoe each, which supporting rods have each a chemical bag at the top with aromatics contained therein to expel odor smell from the shoe mounted thereon.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 1:
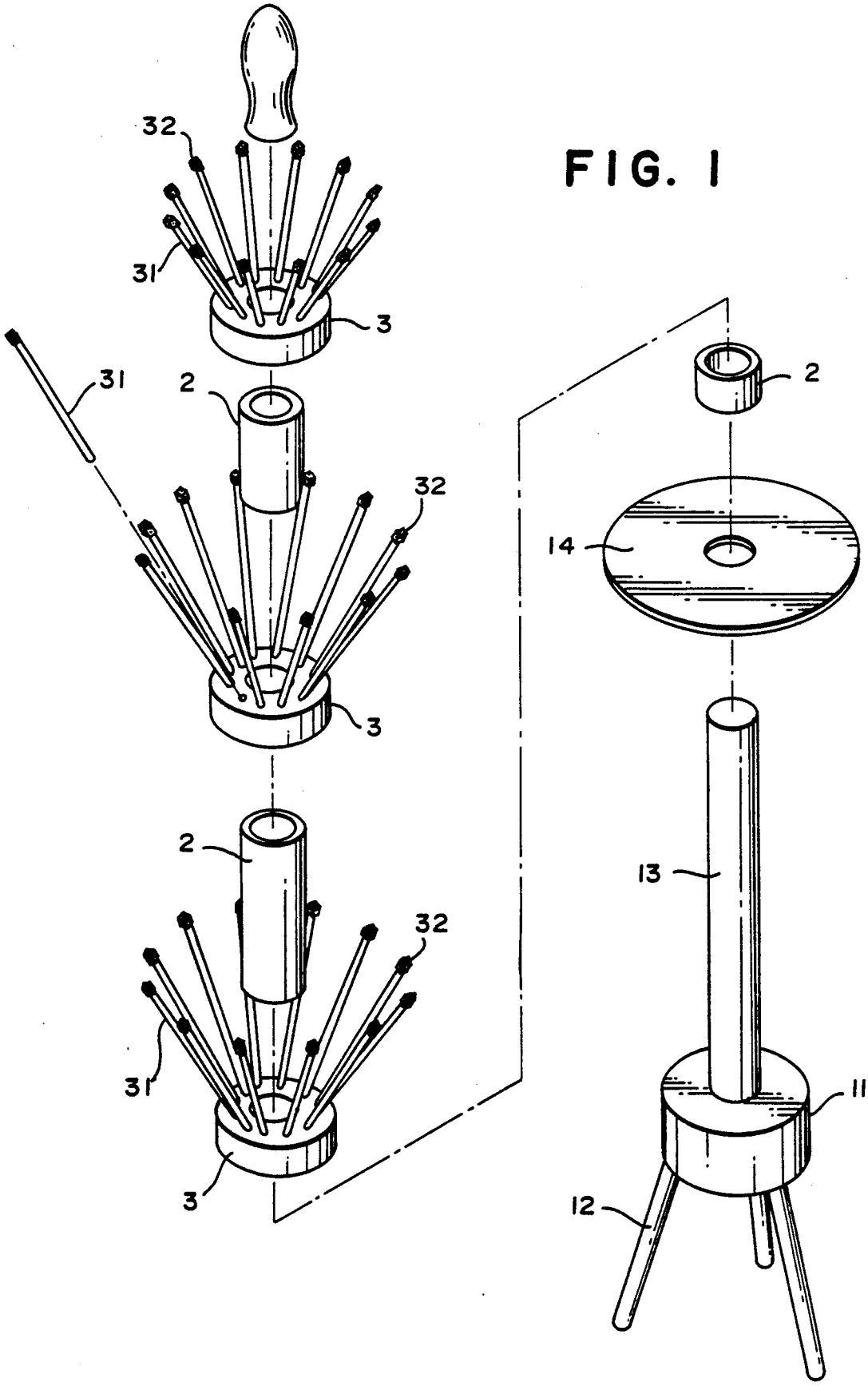
FIG. 1 is a perspective dismantled view of the preferred embodiment of the multi-deck shoe rack of the present invention.

Referring to FIG. 1, a shoe rack in accordance with the present invention generally comprises a base 11 which is supported by stands 12 and has a post 13 upstanding therefrom at the center for mounting a table 13, a plurality of sockets 2 and a plurality of ring-shaped rotary members 3.

The socket 2 is a cylindrical sleeve sleeved on the post 13. The ring-shaped rotary member 3 has a plurality of holes obliquely disposed around a circle on the topmost edge thereof for mounting a plurality of rods 31 which have each a chemical bag 32 at the top which chemical bag 32 contains aromatics to release fragrance.

Figure 2:
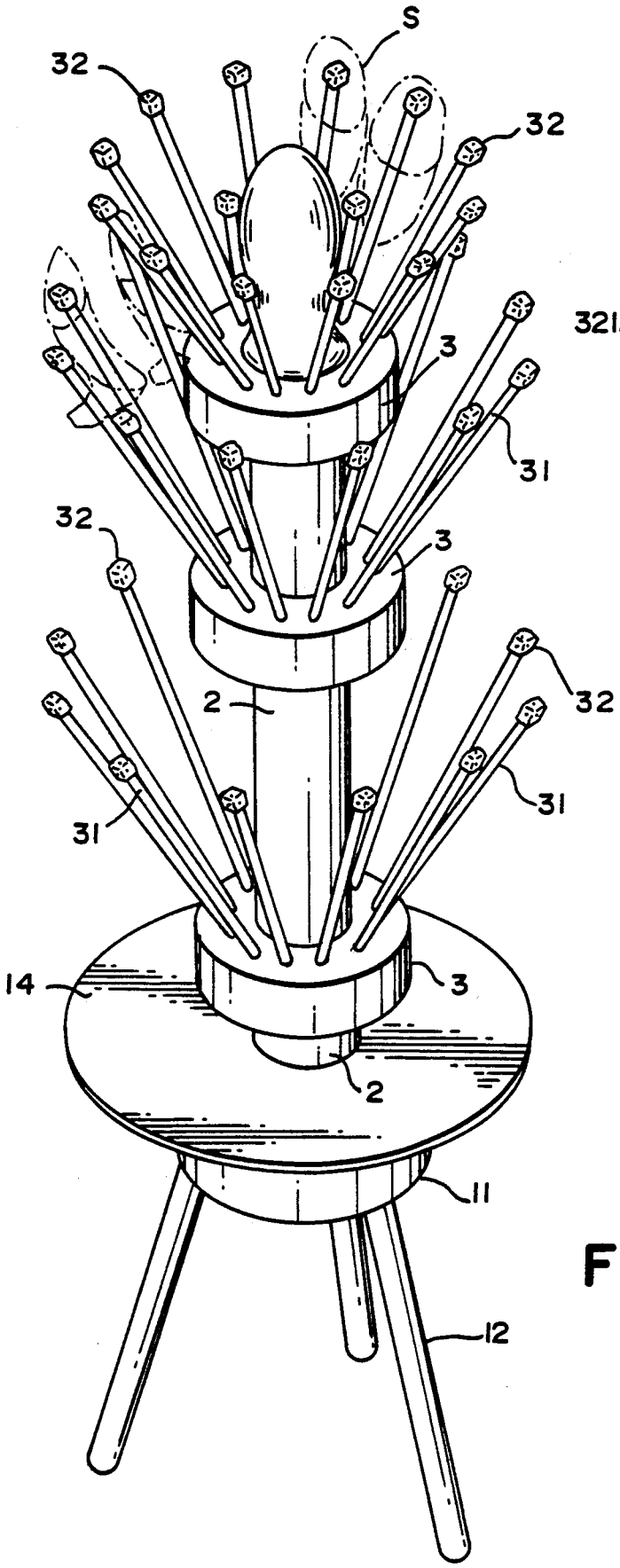
FIG. 2 is a perspective assembly view thereof.
Figure 3:
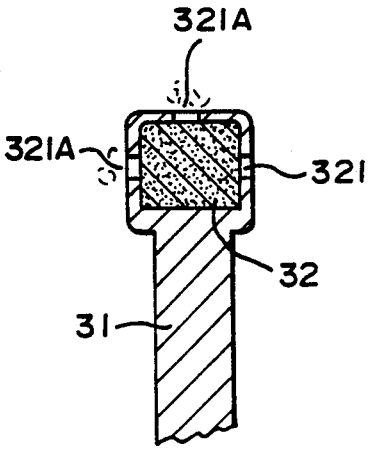
FIG. 3 is a partly enlarged view of the supporting rod.

Referring to FIG. 2, a plurality of sockets 2 and ring-shaped rotary members 3 are alternatively mounted on the post 13 permitting the ring-shaped rotary members 3 to be respectively separated from one another by the sockets 2. By means of the support of the sockets 2, the ring-shaped rotary members 3 can be respectively rotated on the post 13. As shown in the drawing, the rods 32 on each ring-shaped rotary member 3 respectively obliquely project upward outward around a circle. Shoes S can be respectively mounted on the chemical bag 32 and supported by each rod 31. The chemical bag 32, as shown in FIG. 3, has a plurality of fine air passages 321 through which fragrance 321A is released by the aromatics contained therein to eliminate the odor of the shoe mounted thereon. Because each ring-shaped rotary member 3 is supported by a socket 2, it can be conveniently rotated for mounting a shoe on a specific rod 31 or picking it therefrom.

I claim:

1. A multi-deck type of rotary shoe rack, comprising a base supported by a plurality of legs, a post extending from said base, a table mounted on said post above said base, and a plurality of sockets and ring-shaped rotary members alternatingly mounted on said post, and a plurality of rods for supporting shoes thereon, further characterized in that:

said ring-shaped rotary members are respectively separated from one another by said sockets, each having a plurality of holes obliquely disposed around a circle on a topmost surface thereof thereby mounting said plurality of rods therein permitting said rods to be radially projecting upwardly and outwardly from said post for mounting a shoe on each of said rod, said rods each having a chemical bag at a free end thereof, said chemical bag containing aromatics to release fragrance for eliminating odor from said shoe.

* * * * *